United States Patent [19]

Abthoff et al.

[11] Patent Number: 4,733,358

[45] Date of Patent: Mar. 22, 1988

[54] METHOD FOR OPTIMIZING THE AIR/FUEL RATIO UNDER NON-STEADY CONDITIONS IN AN INTERNAL COMBUSTION ENGINE

[75] Inventors: Jörg Abthoff, Plüderhausen; Dieter Schuster, Schorndorf; Christoph Noller, Waiblingen; Ferry Dürschmidt, Friolzheim; Gunter Loose, Remseck, all of Fed. Rep. of Germany

[73] Assignee: Daimler-Benz Aktiengesellschaft, Stuttgart, Fed. Rep. of Germany

[21] Appl. No.: 751,432

[22] Filed: Jul. 3, 1985

[30] Foreign Application Priority Data

Jul. 4, 1984 [DE] Fed. Rep. of Germany ..... 3424532

[51] Int. Cl.[4] ..... F02M 17/00

[52] U.S. Cl. ..... 364/431.05; 364/431.07; 123/489; 123/492

[58] Field of Search ..... 364/431.05, 431.07; 123/440, 489; 60/276, 285

[56] References Cited

U.S. PATENT DOCUMENTS

| | | | |
|---|---|---|---|
| 4,130,095 | 12/1978 | Bowler et al. | 123/440 |
| 4,235,204 | 11/1980 | Rice | 123/440 |
| 4,251,989 | 2/1981 | Norimatsu et al. | 123/440 |
| 4,499,882 | 2/1985 | Saito et al. | 123/489 |
| 4,517,948 | 5/1985 | Kaji et al. | 123/489 |
| 4,545,355 | 10/1985 | Takao et al. | 123/489 |
| 4,622,809 | 11/1986 | Abthoff et al. . | |

FOREIGN PATENT DOCUMENTS

| | | |
|---|---|---|
| 2530847 | 8/1976 | Fed. Rep. of Germany . |
| 3115286 | 3/1982 | Fed. Rep. of Germany . |
| 3036107 | 5/1982 | Fed. Rep. of Germany . |

*Primary Examiner*—Parshotam S. Lall

*Attorney, Agent, or Firm*—Barnes & Thornburg

[57] ABSTRACT

A self-optimizing control method for optimizing the fuel/air ratio under non-steady conditions in an internal combustion engine is described; in this method, a probe is provided both before and after the catalyst. Control quantities and the time during which the post catalyst probe shows an undesirable fuel/air ratio are stored for certain specified engine-operating conditions in the non-steady range. When the same engine operating condition is repeated, reference is made to the stored control quantities and time and the control quantity is varied in the direction of the correct fuel/air ratio. The time now obtained is compared with the stored time and, if the time has decreased, the new control quantity and the new time are stored. The control values are iteratively corrected by repeating these procedures, when the same engine operating condition reappears, until the time reaches a minimum.

12 Claims, 12 Drawing Figures

FIG. 1
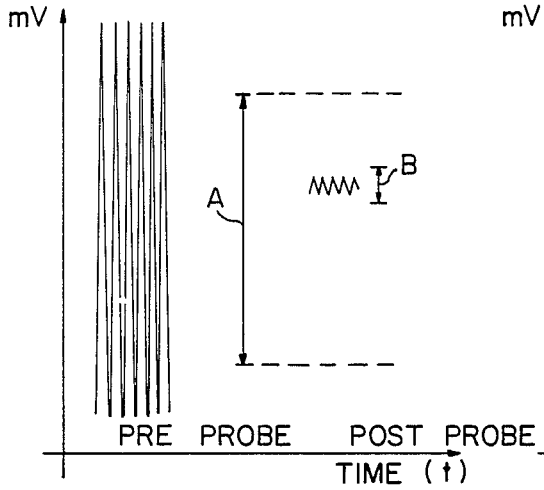
FIG. 2
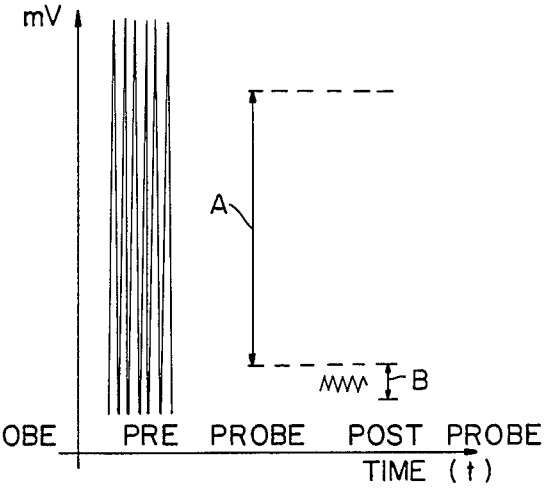
FIG. 3
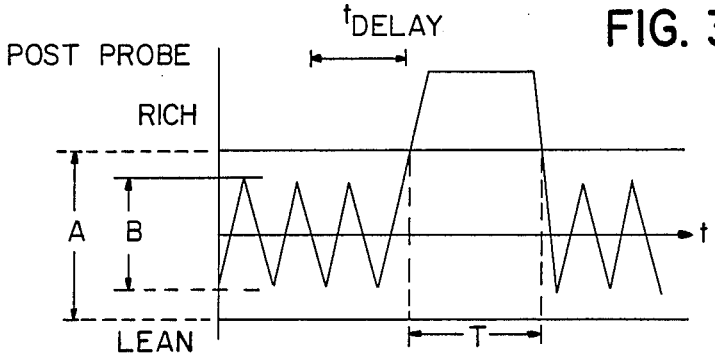
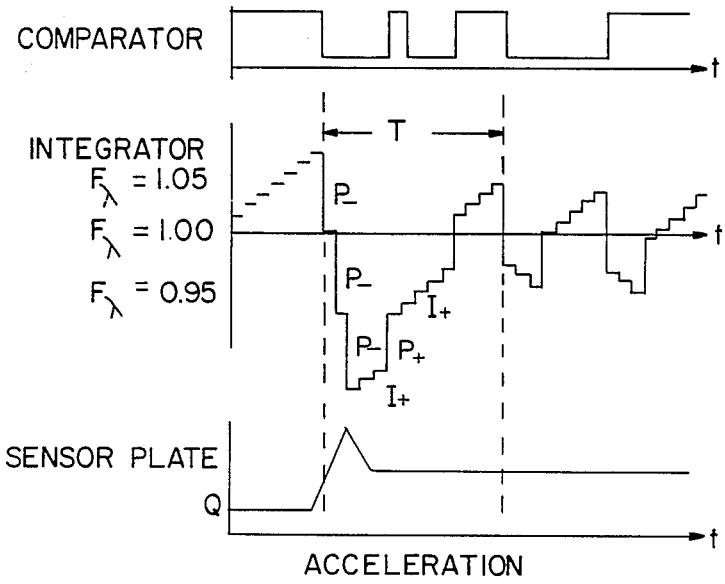

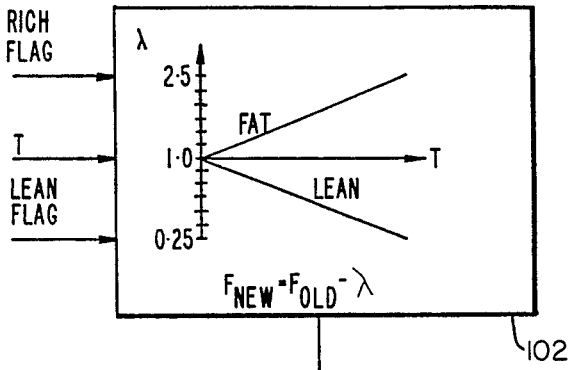
FIG. 10
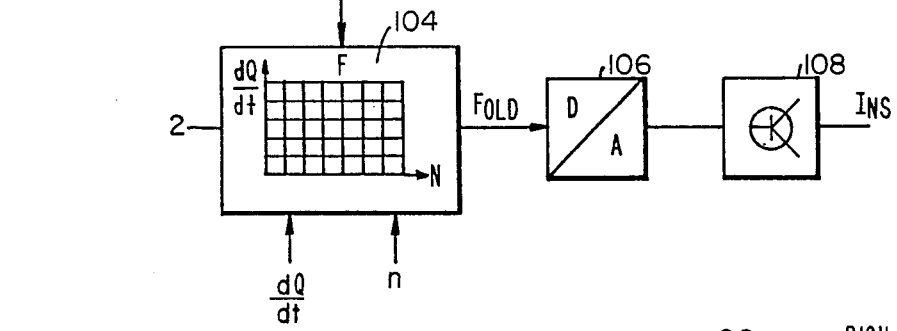
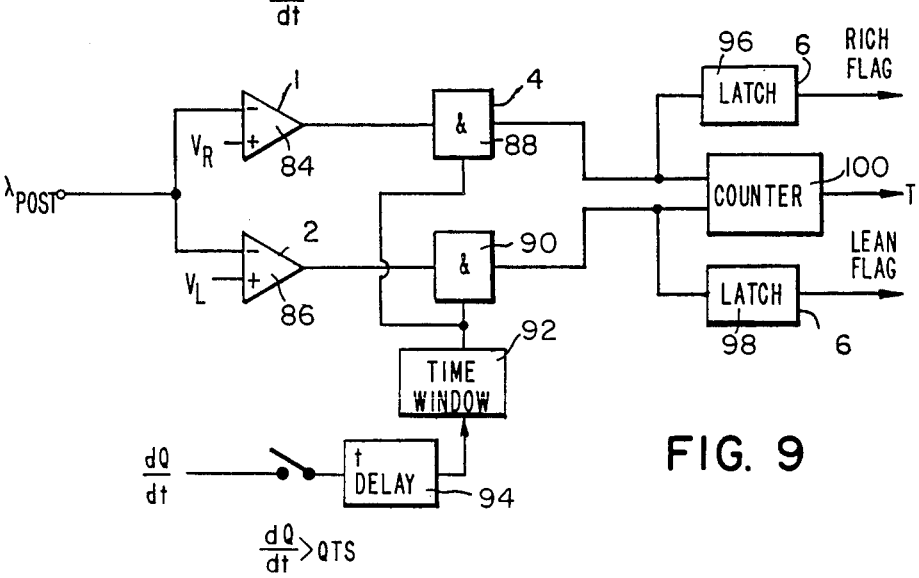
FIG. 9

METHOD FOR OPTIMIZING THE AIR/FUEL RATIO UNDER NON-STEADY CONDITIONS IN AN INTERNAL COMBUSTION ENGINE

BACKGROUND AND SUMMARY OF THE INVENTION

The exhaust gas of internal combustion engines, in particular vehicle engines, contain components which are still combustible (such as carbon monoxide and unburnt hydrocarbons) and oxides of nitrogen. In order to reduce the proportion of these components to a minimum demanded by the authorities, the exhaust gases must be substantially freed from these materials. This means that the combustible components must be oxidized as completely as possible to carbon dioxide and water, and the oxides of nitrogen must be reduced to nitrogen.

Such a conversion is carried out by subjecting the exhaust gases to an aftertreatment over catalysts. It is, however, a precondition for optimum operation of the catalyst that the fuel/air mixture burnt in the engine should approximately correspond to the stoichiometric ratio between air and fuel ($\lambda=1$). For this reason, an electro-chemical sensor ($\lambda$ probe) is installed in the exhaust path befor the catalyst to measure the oxygen content in the gas (for example).

A control device processes the signal emitted by the probe and adjusts the setting of the fuel/air ratio and hence also, to a large extent, of the exhaust gas composition. Such so-called control systems have been known for a long time and, theoretically, they operate satisfactorily. Aging phenomena do, however, appear and these make it impossible to adjust to an optimum mixture as the operational life increases, so that faulty adjustments occur.

According to the U.S. Pat. No. 4,622,804 these faulty adjustments can be corrected by installing a second $\lambda$ probe after the catalyst. The post catalyst probe has a substantially smoother signal relative to that of the pre-catalyst probe and permits simple determination and correction of the control working point. The correction takes place by determining the amplitude and mean value of the output signal of the post-catalyst probe. If the mean value differs from a specified set value, the control working point is altered until post-catalyst probe again achieves its set value. The use of this post-catalyst probe makes it possible to smooth out those particular control errors which are due to aging of the pre-catalyst probe or of the fuel measuring system or which are caused by an excessive hydrogen content in the exhaust gas, which leads to a displacement of the $\lambda$ characteristic.

Although mixture control by the use of post-catalyst probes operates extremely satisfactorily even for long periods, they are inaccurate in the non-steady range, i.e. during dynamic transition from one steady operating condition to a different one, for example during acceleration and braking phases. In actual driving circumstances, this leads to an undesirable deterioration in the exhaust gas parameters.

The object of the invention is to find a control method for optimizing the fuel/air ratio in the non-steady condition in an internal combustion engine which is equipped with a $\lambda$ probe before and a $\lambda$ probe after the exhaust gas catalyst, whereby the undesired exhaust gas components are minimized even under non-steady conditions.

This object is achieved by means of the control system an method which provides a correction signal under non-steady operating conditions and iterates the signal to produce the optimum correction requiring the minimum amount of time to achieve the desired fuel/air ratio. The control system is an improvement in a control system having a pre- and post-exhaust catalyst $\lambda$ probe and adjusts the fuel/air ratio to achieve a desired fuel/air ratio compared to that sensed by the probes. The method includes storing a plurality of sets of control values and time values of the duration which the post-catalyst probe would indicate an undesirable fuel/air ratio for a plurality of sets of specified engine operating conditions in the non-steady range of operation. Once a non-steady range of operation is determined, the specific engine operating conditions are sensed and a corresponding set of a correction control value and a time value are read. The control system modifies the read correction control value as a function of the read time to achieve a desired fuel/air ratio. The time period which the post-catalyst probe indicates an undesirable fuel/air ratio is measured and compared to the read time value. If the measured time value is less than the read time value, the modified correction value and the measured time are stored for the set of sensed engine operating conditions. This process is repeated each time a specific set of engine operating conditions are met. The specific engine operating conditions may include the rotational speed of the engine and the air flow mass which may be measured by deflection of a sensor plate located in the induction ducting. The non-steady range includes acceleration and deceleration. The modification of the correction control values includes determining whether the fuel/air ratio is rich or lean and modifies the correlation based upon this determination and the read time. The non-steady state correction system requires a minimum level of non-steady state range operation before providing a correction signal.

Other objects, advantages and novel features of the present invention will become apparent from the following detailed description of the invention when considered in conjunction with the accompanying drawings.

BRIEF DESCRIPTION OF THE DRAWINGS

FIG. 1 shows, diagrammatically, the signals from the pre-catalyst probe (control probe) and the post-catalyst probe (test probe) with desirable fuel/air ratio.

FIG. 2 shows, diagrammatically, the signals with undesirable fuel/air ratio.

FIG. 3 gives a general diagrammatic representation of the post-probe signal occurring during a dynamic change of condition in the engine.

FIG. 7A–C is a diagrammatic representation of the signals of the non-steady range controller of FIG. 4.

FIG. 9 is a general schematic for the recovery time measuring and rich/lean detector of FIG. 4.

FIG. 10 is a diagrammatic schematic of the non-steady condition control signal calculator of FIG. 4.

DETAILED DESCRIPTION OF THE DRAWINGS

Figure 4:
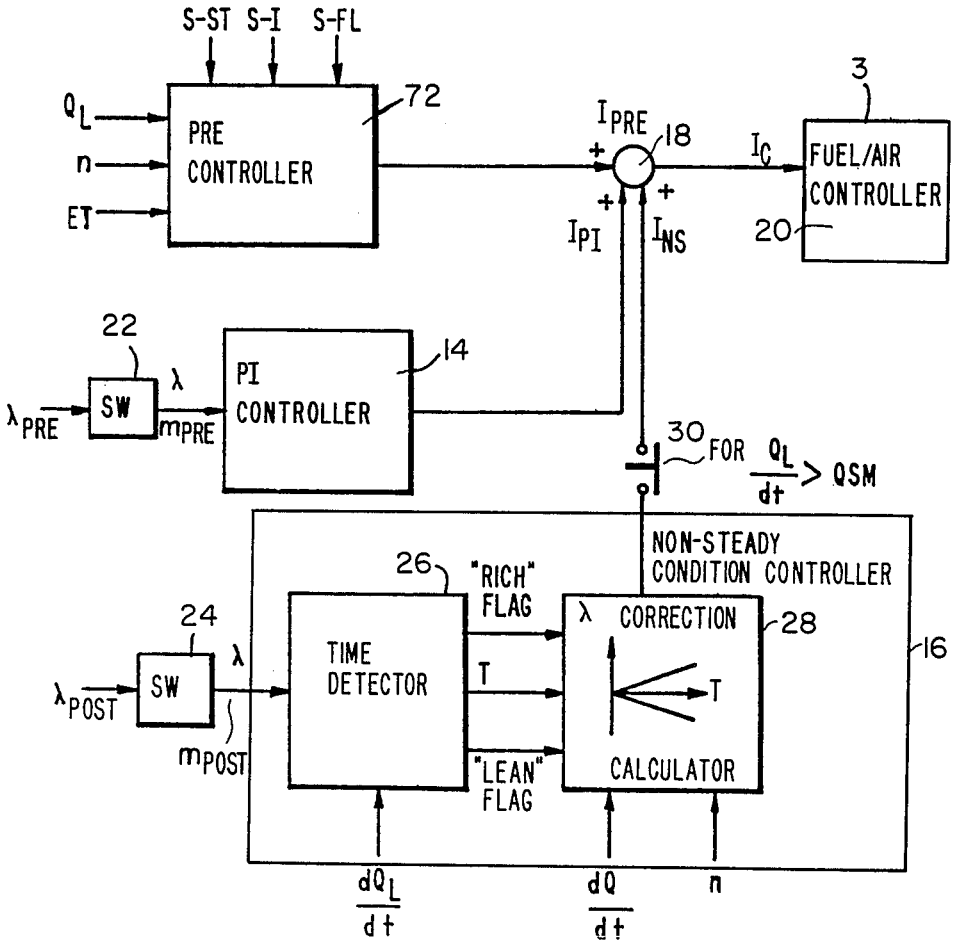
FIG. 4 is a block diagram of a fuel/air ratio control system incorporating the principles of the present invention.

The control system discussed above includes a control or pre-catalyst λ probe sensor and a test or post-catalyst λ probe. The pre-catalyst probe is connected to an analysis circuit, preferably including a PI controller. During continuous control the signal shown in FIG. 1, which oscillates regularly from a high value to a low value, occurs at the post-catalyst probe. This regular oscillation, however, also occurs at the pre-catalyst probe when, for any reason, the control working point (mean position) is displaced. The control process then continues in a manner which is, in itself, correct but the result of the control no longer corresponds to the desired fuel/air ratio but is displaced into the rich or lean range.

The exhaust gas flow is again measured at the post-catalyst probe. Due to the conversion of the exhaust gases on the catalyst, the post-catalyst probe generates a signal which is markedly different from the pre-catalyst probe signal, provided the exhaust gas cleaning equipment is operating correctly. The amplitude of the post-catalyst probe signal is substantially smaller—zero in the ideal case—than that of the pre-catalyst probe signal and the mean voltage of the post-catalyst probe signal corresponds to the actual residual oxygen content in the exhaust gas. The post-catalyst probe signal is plotted in FIG. 1, A being the tolerance field within which the mean value of the post-catalyst probe voltage is allowed to vary and B being the peak-to-peak range within which the amplitude of the post-catalyst probe voltage must be limited.

FIG. 2 shows the signal of the pre-catalyst probe and the associated signal of the post-catalyst probe when the control characteristic of the post-catalyst probe is displaced.

Using the signals made available by the post-catalyst probe, proportional signals, to influence the pre-catalyst probe in a complementary manner, can then be obtained. The speed with which the post-catalyst probe signal is returned to the range A, is influenced by affecting the P signal (proportional effect) step of the control and the integrator signal I influences the frequency of the control oscillation and, therefore, enables the conversion rate of the catalyst to be optimized. The P signal (proportional effect) can, in this process, have its magnitude affected and also, particularly in the case of digital operation of the control, be generated by multiple output of a constant P value.

FIG. 3 shows the signal of the post-catalyst probe under dynamic conditions during an acceleration period. The acceleration demands increased air flow, which is recognized by the deflection of a sensor plate in the induction ducting of the engine. In this example, the fuel/air ratio is displaced into the rich region. After a delay period ($t_{delay}$), which is caused by the gas throughput time, the post-catalyst probe signal leaves the permissible range A in the rich direction and remains outside this range for the time interval T, returning into the range A when the new steady condition is reached. It is, of course, assumed that the steady condition control point, as such, is also optimized to a fuel/air ratio of 1 for the steady condition using the post-catalyst probe.

The optimization procedure then assumes that the variation with time of the faulty adjustment of the control main fuel supply system can be sufficiently controlled by the post-catalyst probe signal emerging from the permitted range A and by the time T until it finally returns into it. If this time T can be successfully reduced or made to disappear completely, the pollutant effect of the exhaust gas in the unsteady range can be substantially reduced. This, however, is only possible if the main control is supplied with additional correction factors at the beginning of the unsteady condition to act appropriately against the faulty adjustment of the system due to the non-steady conditions.

The overall control system which incorporates the present invention is illustrated in FIG. 4 as including a pre-controller 12, a PI controller 14 and a non-steady condition controller 16 providing current $I_{RF}$, $I_{PI}$ and $I_{NS}$ respectively to summing point 18 which provides a single correcting value current IC to a fuel/air ratio controller 20, the pre-controller 12, PI controller 14 and fuel/air ratio controller 20 are part of a prior art device, for example a k-jetronic KE3 from Bosch. The pre-controller 12 includes switch status inputs of the start switch S-ST, the idle state switch S-I and the full load switch S-FL and input of particular engine operating conditions, for example intake air volume Q, fuseable engine speed n and engine temperature ET. The pre-controller uses its input to produce a pre-control current $I_{PRE}$. The calculation and content of the pre-controllers is well known and will not be described in detail.

The PI controller 14 has its input connected to the pre-catalyst probe λ PRE via detection switch 22 for which produces signal λ MPRE which represents a minimum fuel/air ratio deviation value and rich/lean indication. The PI controller 14 is a well knwn device which generates P and I signals to produce correcting PI current $I_{PI}$ to the summer 18. The calculation and content of the PI controller 14 is well known and will not be described in detail.

The modification of the present invention to the control system includes the non-steady condition controller 16 which receives a λm post signal from the post-catalyst probe via detection switch 24 which represents a minimum fuel/air ratio deviation and rich/lean indication. In addition to the post-catalyst signal λm post, the non-steady condition controller 16 has an input for the rate of change of air d/dt and engine speed n. The non-steady condition controller 16 includes a time detector 26 and a correction calculator 28. The output of the correction calculator 28 is a non-steady state correcting current $I_{NS}$ provided to the summing point 18 through a control switch 30 which provides the correcting current $I_{NS}$ for a rate of change of air above a minimum level. This minimal level determines an appropriate non-steady state condition before the correction.

Figure 5:
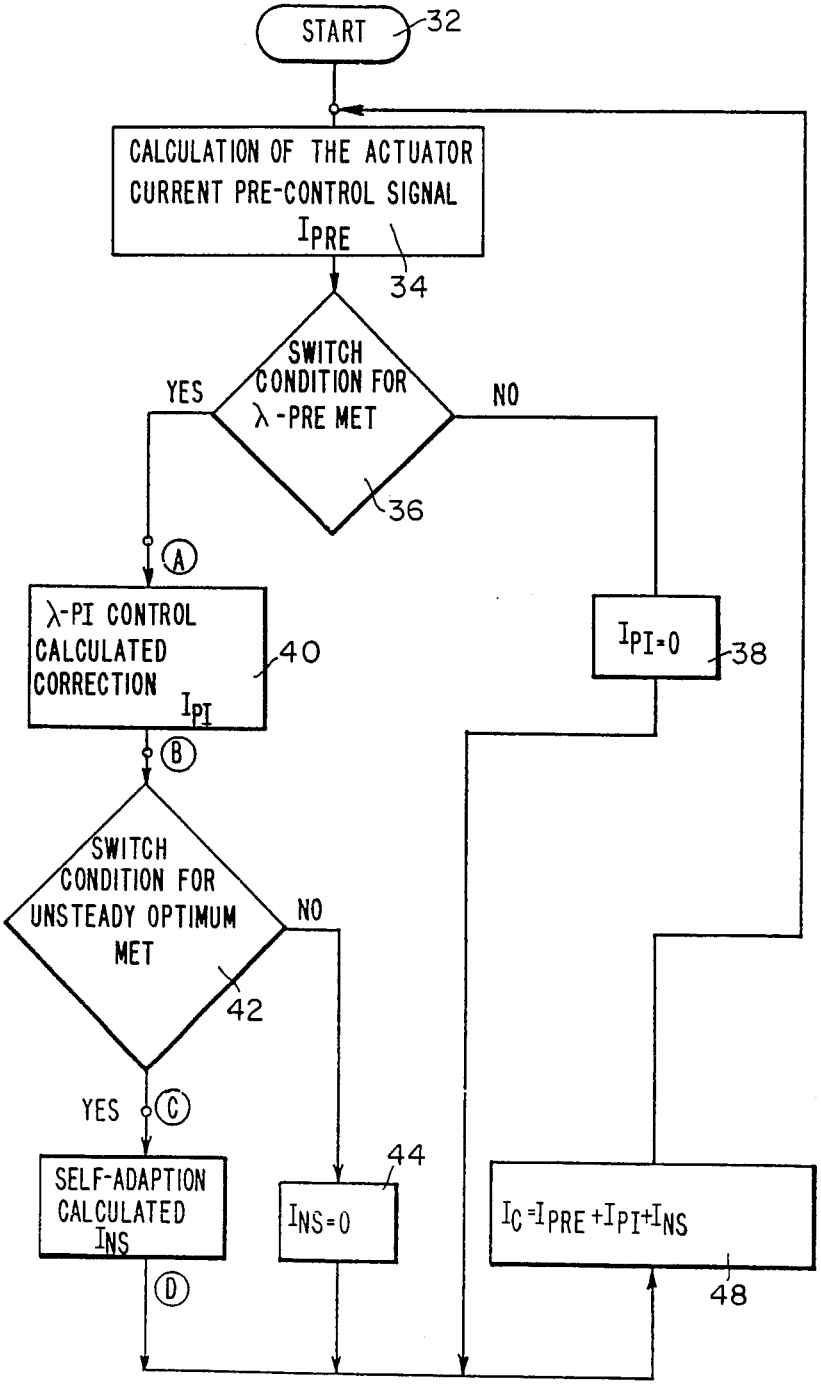
FIG. 5 is a flow diagram of the operation of the system of FIG. 4.

An overall flow diagram for the controller of FIG. 4 is illustrated in FIG. 5. The system begins with start at 32. The pre-control signal $I_{PR}$ is calculated at 34. Decision is made at 36 whether the switch condition (minimum deviation) for the pre-catalyst probe is met. If it is not met the PI controller 14 sets $I_{PI}=0$ at 38. If the condition is met, the PI controller 14 calculates a correction $I_{PI}$ at 40. The switch condition for the unsteady operation range is determined at 42. If the system is not in a steady operating range, the non-steady state controller 16, ds $I_{NS}=0$ at 44. If it is in the non-steady operating range, the non-steady correction current $I_{NS}$ is calculated at 46. The correcting current value $I_C$ is calculated at 48 as the sum of the pre-correcting current, the PI correcting current and the non-steady correcting current.

Figure 6:
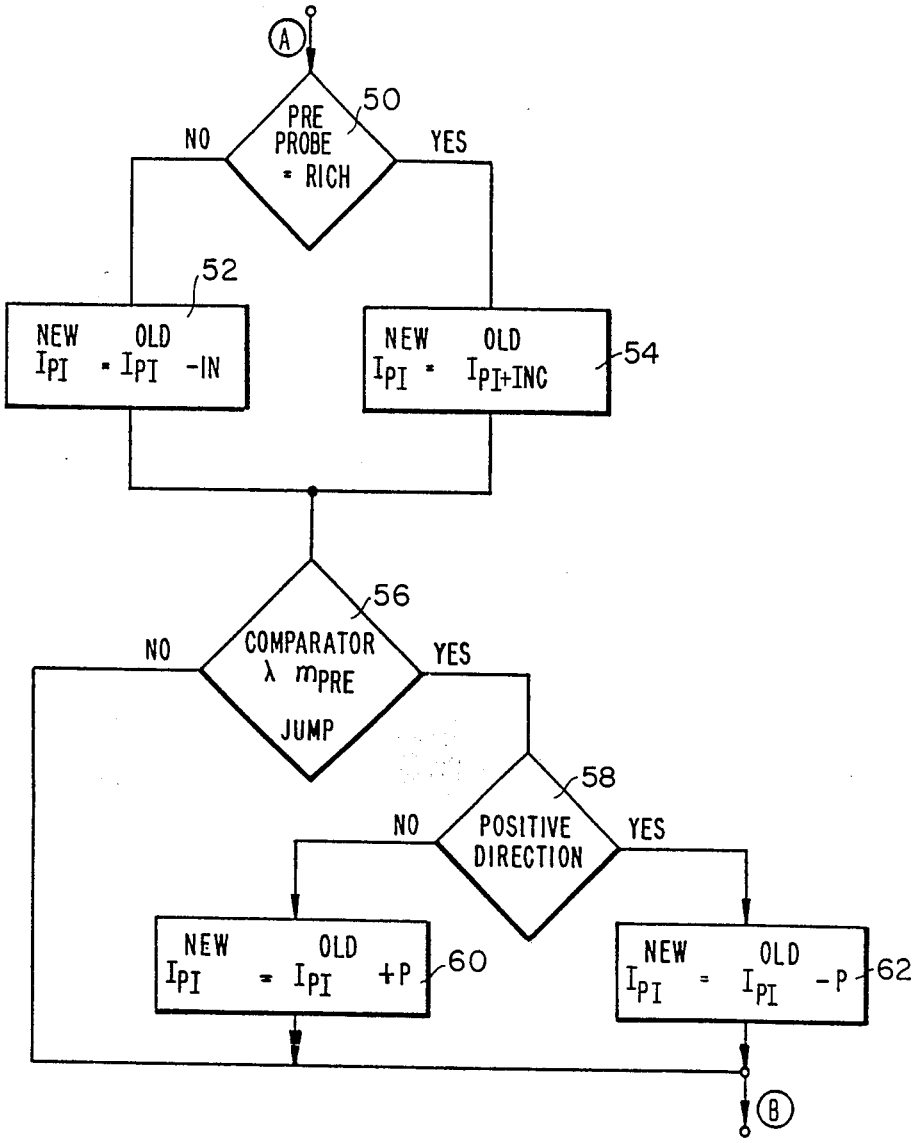
FIG. 6 is a flow diagram of the PI controller of FIG. 4.

Further description of the PI controller calculation of box 40 is illustrated in FIG. 6. Determination is made at 50 on whether the pre-probe senses a rich fuel/air ratio. If it does not detect the rich fuel/air ratio, the new PI correcting current $I_{PI}$ is the old current decremented by a step of I at 52. If the fuel/air ratio in the pre-catalyst probe is rich, then the new correcting current $I_{PI}$ is the old correcting $I_{PI}$ current incremented by the value I at 54. The fuel/air ratio for the pre-catalyst probe is compared to see if there is a significant change at 56. If there is not a significant change, no further modification to the correcting signal $I_{PI}$ is made at 56. If there is a significant change, it is determined whether it is positive at 58. If it is not positive, the new correcting current $I_{PI}$ is said equal to the old correcting current $I_{PI}$ plus a P increment at 60. If there is a positive change, the new current $I_{PI}$ is said equal to the old current minus the P increment at 62.

Figure 8:
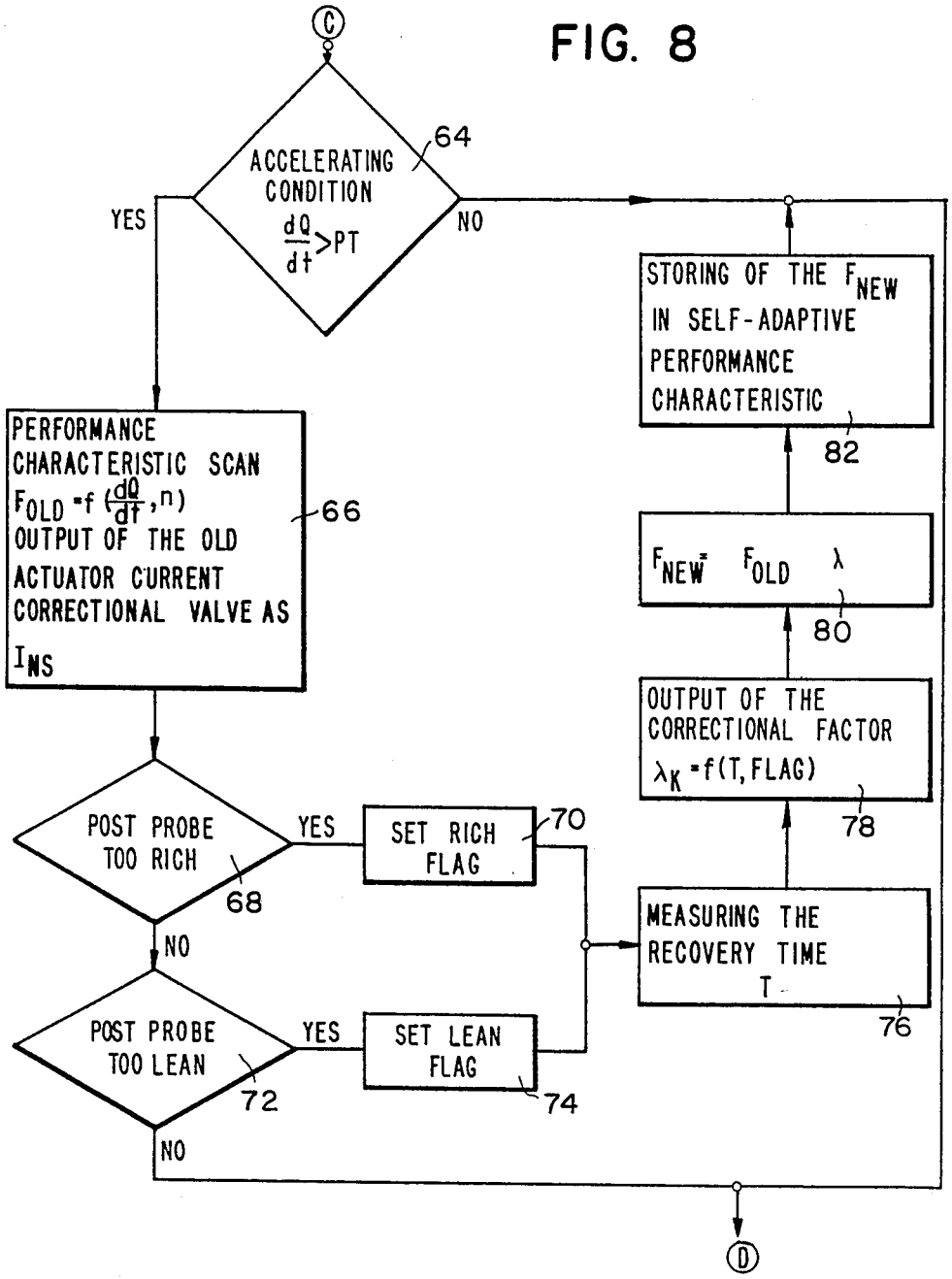
FIG. 8 is a flow diagram of the non-steady range controller of FIG. 4.

The operation of the unsteady state condition controller 16 is illustrated in the flow chart of FIG. 8. Initially, an acceleration condition is determined at 64 by measuring the rate of change of air compared to a pre-set value PT. If it is not greater than the pre-set value PT, no non-steady operating condition signal is provided. If a minimum non-steady condition is sensed, a previous correcting factor $F_{old}$ is determined from the operating characteristics at 66 to produce a correcting current $I_{NS}$. The operating characteristics are the rate of change of the air flow d/dt and the engine speed n. A determination is made whether the post-catalyst probe senses a rich mixture at 68. If it does the rich flag is set at 70. If not, the determination is made at 72 on whether the post-catalyst probe senses too lean a mixture. If it is not too lean, the old correcting factor $F_{old}$ is maintained and processing is over for $I_{NS}$. If the measure is too lean, the lean flag is set at 74. With the determination of a too lean or too rich mixture, the recover time T that it take the control system to bring the fuel/air ratio at the post-catalyst probe into range for these operating conditions in a previous occurrence is read and a new time is measured at 76. A correcting value λ is then determined using the previous recovery time $T_{old}$ and whether the mixture is too lean or too rich. This is used to calculate a new correcting factor $F_{new}$ as a function of the old correcting factor $F_{old}$ times the λ K at 80. If the new recovery time $T_{new}$ of the new $F_{new}$ is less than the old recovery time $T_{old}$ of the $F_{old}$, the $F_{new}$ is substituted in storage for $F_{old}$ with the new recovering time $T_{new}$ in block 82.

The hardware to accomplish the operation of FIG. 8 is illustrated in FIGS. 9 and 10. The rich/lean detector 24 illustrated specifically in FIG. 9, includes a pair of comparators 84 and 86 to compare the fuel/air ratio sensed by the post-catalyst probe with a rich reference $V_R$ and a lean reference $V_L$ respectively which define the boundaries of A in FIG. 3. If the signal should exceed either the rich or lean boundary of A, the appropriate comparator 84, 86 provides a signal to AND gate 88 or 90 respectively. The AND gates 88 and 90 act as transmission gates upon the occurrence of a timing signal from time window device 92 which may be a one shot multi-vibrator. The time window device 92 is activated by a minimum change of rate of the air flow which signifies a non-steady state condition after a delay $t_{delay}$ produced by the delay device 94. The delay time is equal to the time between the beginning of a non-steady condition and the time it takes the undesirable fuel ratio to reach the post catalyst probe. The period of the time window 92 is selected longer than any anticipated excursion T of the post-catalyst probe before the control system can bring it back into the boundaries A.

The outputs of AND gates 88 and 90 are connected to a respective latch 96 and 98 to set the rich flag or lean flag high respectively. The outputs of the AND gate 88 and 90 are also provided to a signal to counter 100 which measures the time period which it takes for the control system by bring the fuel/air back to a desired level and produces the time signal T.

The time T and the rich and lean flags are provided to a correction calculator 102 in FIG. 10 which maybe a micro processor. This processor includes an algorithm which calculates a new correction factor $F_{new}$ as a function of the old correction factor $F_{old}$ times a corresponding fuel/air ratio λ K of the present measured time T. The correction calculator 102 also includes a computer and integrator for P and I corrections, to be described in FIGS. 7A–C. The correction calculator 102 also includes a comparator and integrator for P and I corrections, to be described in FIGS. 7A–C. The correcting factor F is stored with its time T as a function of the air flow rate d/dt and the engine speed defining a specific non-steady condition. The new correcting factor $F_{new}$ is now provided to a Look up Table 104 which stores correction factors F and T as a function of engine of rate of air/flow dg/dt and engine speed n. Look up table 104 thus has a plurality of correcting factor F and appropriate time period T stored therein as a function of operating characteristics dg/dt and n. The digital correcting factor F is provided to a digital to analog. Convertible 106 which provides a voltage $V_K$ which converted to the correcting non-steady state correcting current $I_{NS}$ by an amplifier 108.

Since the concenvable number of operating points in non-steady operation is practically infinite, representative engine operating conditions, for which these control quantities are to be determined, are selected - depending on the desired fineness of the adjustment. These specified engine operating conditions are stored electronically in a set of characteristics. It is generally sufficient to store between two and five dynamic operating conditions, the conditions being preferably characterized by a set of rotational speed n and air flow ranges d/dt (for example, position of the throttle butterfly). The optimization is then based on the idea that every time a certain specified dynamic engine-operating condition or range of conditions is reached, the correction parameters F for the correction of the basic setting in the direction of a correct air/fuel ratio is stored and the time needed by the test probe signal to return into the correct range is also stored. If the engine again reaches the same specified engine-operating condition in an unsteady range, the stored control value F is varied in the direction of the correct fuel/air ratio using the stored T and the time T now needed for the test probe signal to normalize is measured. If this period is shorter than the originally stored period, the new correction signal F and its T for that operating condition is stored instead of the original one. By repeating these procedures each time the new engine operation condition or condition range appears, the correction values F are iteratively optimized until the period T in which the post-catalyst probe signal is located outside the desired range A becomes a minimum or, in the most favorable case, is equal to zero.

FIG. 3 shows the signal appearing during a dynamic change to the engine conditions. Because of the acceleration, the exhaust gas composition is displaced into the rich region. This displacement is recognized by a rise in the post-catalyst probe signal after a delay period, which is due to the gas passage time from the sensor plate to the post-catalyst probe. It may be seen from the integrator signal of FIG. 7B that a corrective signal has occurred by multiple output of the P control proportion from the non-steady condition controller 16 from the non-steady condition controller 16 on entering into the specified engine-operating condition. This indicates that this engine operating condition has already appeared several times. The presence of the particular change to the operating condition is recognized because of the moment-of-inertia property of the engine, which is characterized by the fact that corresponding change to the sensor plate (see FIG. 7C) takes place at a rotational speed which, at the same time, remains instantaneously constant. Because of this instantaneous engine rotational speed, the corresponding gas passage time is simultaneously known and a time window t delay, within which the control emits the corresponding counter-signal, can be specified.

As soon as the post-catalyst probe leaves the range A after the expiration of t delay, the time T is measured and subsequently analyzed as the criteria for hte quality of the corrective-measure F initiated, a comparison being made with the current corrective-measure for the optimum value $T_{min}$. The new correction factor F gained in this manner is stored. In general, it is sufficient to select between two and five engine operating conditions or condition ranges for a sufficiently accurate control which gives low pollutants. The possibility of refining the control by storing a larger number of engine operating conditions does, however, remain. In actual driving operations, it is then possible—after a certain running-in period during which control is optimized by a self-learning process—to generate an exhaust gas which is practically free from pollutants even during acceleration phases and deceleration phases because, on entry into the particular operating condition, the optimum correction factors, by which the basic correction for the steady range must be corrected, are immediately available for each particular case.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. A control method for optimizing the fuel/air ratio under non-steady conditions in an internal combustion engine, which is equipped with a pre- and post-exhaust gas catalyst probe and a control system for adjusting undesired fuel/air ratio recognized by said probe comprising:

storing a plurality of sets of correction control values and time values of the duration which the post-catalyst probe indicates an undesirable fuel/air ratio, for a plurality of sets of specified engine-operating conditions in the non-steady range;

determining a non-steady range of operation;

sensing engine operation conditions, reading a set of a correction control value and a time value for the sensed engine-operating conditions, and modifying said read correcting control value to achieve a desired fuel/air ratio;

measuring the time the post catalyst probe indicated undesirable fuel/air ratio using said modified correcting control value;

comparing said measured time with the read time value; and storing said modified correction value and measured time value for the set of sensed engine operating conditions if said measured time value is less than said read time value.

2. A control method according to claim 1, wherein sensing engine operating conditions include sensing the rotational speed of the engine and the air mass flow.

3. A control method according to claim 2, wherein sensing the air mass flow includes measuring the deflection of a sensor plate located in the induction ducting.

4. A method according to claim 1, wherein said storing stores a plurality of a set of values for an acceleration and deceleration non-steady range.

5. A method according to claim 1, wherein modifying said correction control value includes determining if the fuel/air ratio is rich or lean and modifying said corrective control value as a function of the rich or lean determination and time.

6. A method according to claim 1, wherein determining said non-steady range of operation includes determining a minimum level of non-steady range of operation.

7. A method according to claim 1, wherein said modifying includes determining a correction constant as a function of stored time and modifying said stored correction control value using said correction constant.

8. In a control system for correcting fuel/air ratio of an internal combustion engine having a pre- and post-exhaust gas catalyst probe and means for adjusting said fuel/air ratio in response to ratios sensed by said probes to achieve a desired fuel/air ratio the improvement being means for providing non-steady sense of operation correction signal to said adjusting means comprising:

means for storing a plurality of sets of correcting control values and time values of the duration which the post-catalyst probe indicates an undesirable fuel/air ratio, for a plurality of sets of specified engine-operating conditions in the non-steady range;

means for determining non-steady range of operation;

means for sensing engine operating conditions;

means for reading a set of a correction control value and a time for said sensed engine operating conditions;

means for modifying said read correction control value to achieve a desired fuel/air ratio and providing said signal to said adjusting means in response to a determined non-steady range;

means for measuring the time the post-catalyst probe indicates an undesirable fuel/air ratio using said modified correction value;

means for comparing said measured time value with said read time value; and means for storing said modified correction value and measured time value for the set of sensed engine operating conditions if said measured time value is less than said read time value.

9. A control system according to claim 8, wherein said sensing means includes means for sensing rotational speed of the engine and air mass flow.

10. A control system according to claim 9, wherein said means sensing air mass flow includes means for measuring the deflection of a sensor plate located in the induction ducting.

11. A control system according to claim 8, wherein said determining means includes means for determining a minimum level of non-steady range of operation.

12. A control system according to claim 8, wherein said modifying means includes means for determining a correction constant as a function of stored time and means for modifying said stored correction value using said correction constant.

* * * * *